US005799830A

United States Patent [19]

Carroll et al.

[11] Patent Number: 5,799,830

[45] Date of Patent: Sep. 1, 1998

[54] PRESSURE VESSEL ACCESS PORT

[76] Inventors: David C. Carroll, 573 Eagle Ridge Dr., Hyrum, Utah 84319; Dennis Brown, 343 W. 400 North, Logan, Utah 84321

[21] Appl. No.: 744,418

[22] Filed: Nov. 8, 1996

[51] Int. Cl.[6] ..... B65D 35/28

[52] U.S. Cl. ..... 222/95; 222/105; 222/389; 222/530

[58] Field of Search ..... 222/95, 105, 386.5, 222/389, 530

[56] References Cited

U.S. PATENT DOCUMENTS

| | | | |
|---|---|---|---|
| 3,134,519 | 5/1964 | Tidd | 222/530 |
| 3,780,910 | 12/1973 | Wagner | 222/95 |
| 4,058,123 | 11/1977 | May | 128/278 |
| 4,416,595 | 11/1983 | Cromie | 417/476 |
| 4,904,239 | 2/1990 | Winchell et al. | 604/51 |
| 5,163,909 | 11/1992 | Stewart | 604/140 |
| 5,192,272 | 3/1993 | Faure | 604/141 |
| 5,308,335 | 5/1994 | Ross et al. | 604/141 |
| 5,399,166 | 3/1995 | Laing | 604/146 |
| 5,693,017 | 12/1997 | Spears et al. | 222/95 |

*Primary Examiner*—Philippe Derakshani

[57] ABSTRACT

A disposable fluid transport system is provided for dispensing sterile fluids from a pressure vessel. The pressure vessel has an internal chamber with an outlet opening extending therethrough. The fluid transport system includes a collapsible media bag having an internal compartment defining a sterile environment. A first end of a delivery tube is attached in fluid communication to the compartment of the media bag. Disposed at a point along the length of a delivery tube is an interface adapter. The interface adapter includes an annular flange which encircles and radially projects out from the exterior surface of the delivery tube. The gasket is formed of a resiliently flexible material and has an outside diameter that is larger than the inside diameter of the outlet opening on the pressure vessel. Once the media bag and delivery tube are positioned within the chamber of the pressure vessel, the second end of the delivery tube can be fed out the outlet opening. As a result of the flexible nature of the gasket, the gasket can also be constricted to pass through the outlet opening and then radially expanded. A clamp can then be used to seal the gasket on the outlet opening so as to seal the outlet opening closed.

54 Claims, 10 Drawing Sheets

PRESSURE VESSEL ACCESS PORT

BACKGROUND OF THE INVENTION

1. The Field of the Invention

The present invention relates to systems for dispensing liquids and, more specifically, disposable systems for selectively dispensing sterile fluids.

2. The Relevant Technology

Breakthroughs in the biological, pharmaceutical, and chemical fields are occurring at a rapid rate. As a result of the substantial research taking place and the many new applications introduced thereby, large amounts of sterile fluid materials are consumed. Cell culture media used in the biological field is one example of a sterile, fluid material. Scientists and technicians often require cell culture media for use in propagating cell and tissue cultures. Cell culture media is typically a solution of amino acids, electrolytes, serum, serum fractions, vitamins, and growth factors.

Practical use of sterile fluid materials requires that the fluids be dispensable in both an accurate and rapid fashion. Furthermore, the fluids must be dispensable in a fashion to maintain sterility. Even a slight breach of the sterile system can result in extensive costs resulting from contamination of large quantities of sterile material and the destruction of experiments or developments of cell cultures.

Dispensing of sterile fluids has been performed in a variety of different fashions. In one embodiment, sterile fluids are poured within the chamber of a pressure vessel. A delivery hose is formed in communication with the chamber. After the fluid is poured in the chamber, the chamber is sealed closed and pressurized. The delivery hose is then selectively opened resulting in the fluid passing through the delivery tube as a result of the pressure differential.

A problem frequently encountered in this process is, however, maintaining sterility of the fluid. It is both difficult and inconvenient to deliver the fluid into the chamber of the pressure vessel without compromising the sterile property of the fluid. Furthermore, it is difficult to ensure that the pressure vessel and delivery tube have been properly sterilized to prevent contamination of the fluid. Use of the pressure vessel is also time consuming since the chamber of the vessel must be repeatedly cleaned and sterilized for each different fluid that is used.

In one attempt to overcome some of the shortcomings of using a pressure vessel, a collapsible bag is used in combination with the pressure vessel. The bag is positioned within the chamber of a pressure vessel and attached in fluid communication with a spout on the interior surface of the chamber. A separate hose is then attached to a spout on the exterior surface of the pressure vessel. A passageway extends between the two spouts to allow fluid to flow therebetween. By pressurizing the chamber, the bag collapses resulting in dispensing the sterile fluid through the passageway between the spouts and into the tube attached thereto.

Although such a system alleviates several problems, several shortcomings still exist. For example, attachment of the bag to the spout on the interior of the pressure vessel jeopardizes the sterility of the fluid. This is because the bag must be openly exposed to the atmosphere and because the bag must be directly attached to the spout. It is again difficult to determine whether the spout has been properly sterilized. Furthermore, the spout must be repeatedly cleaned between uses. This same concern is also applicable to the attachment of the hose on the spout on the outside of the pressure vessel.

As such, it is necessary to ensure that the spout is properly and repeatedly cleaned and sterilized.

OBJECTS AND SUMMARY OF THE INVENTION

It is therefore an object of the present invention to provide improved methods and systems for dispensing a sterile fluid material.

It is another object of the present invention to provide methods and systems that are disposable to eliminate cleaning and sterilizing steps.

Yet another object of the present invention is to provide methods and systems that are used in combination with a pressure vessel.

Still another object of the present invention is to provide methods and systems which do not require fluid attachment directly to the pressure vessel.

Yet another object of the present invention is to provide methods and systems that increase the integrity of the sterility of the fluid.

Finally, another object of the present invention is to provide methods and systems which produce an easy and more effective seal between the system and the pressure vessel.

To achieve the foregoing objectives and in accordance with the invention as broadly disclosed and claimed herein, a fluid dispensing system is provided. The fluid dispensing system includes a pressure vessel that is coupled with a fluid transport system. The pressure vessel comprises a housing having an exterior surface and an interior surface. The interior surface defines a chamber. Mounted on the exterior surface of the housing is a sealing flange having an exposed face. An outlet opening with an inner diameter extends through the face on the sealing flange so as to be in fluid communication with the chamber of the pressure vessel.

The fluid transport system includes a collapsible media bag that is fluid coupled with a flexible delivery tube. The collapsible media bag has an interior surface defining a compartment for containing a sterile fluid. The flexible delivery tube has a first end in sealed fluid communication with the compartment of the media bag and an opposing second end that is sealed closed. The collapsible media bag and the delivery tube attached thereto are configured to be received within the chamber of the pressure vessel.

The fluid transport system also includes an interface adapter. The interface adapter includes a tubular member having a first end, an opposing second end, and an exterior surface extending therebetween. The tubular member also has an interior surface defining a passageway extending between the first end and the second end. The tubular member is fluid coupled in axially alignment with a delivery tube at a point between the first end of the delivery tube and the second end of the delivery tube.

The interface adapter also includes a gasket encircling and radially extending out from the exterior surface of the tubular member. The gasket extends to an outside perimeter that is larger than the inner diameter of the outlet opening extending through the sealing flange. The gasket is sufficiently flexible that when the second end of the delivery tube is passed from within the chamber through the outlet opening, the interface adapter can be constricted to also pass through the outlet opening in the sealing flange. Once the gasket has passed through the outlet opening, the gasket can then be expanded to enable the gasket to be mounted flush against the face of the sealing flange.

Once the gasket is biased against the sealing flange, a clamp can be used to secure the gasket against the sealing flange so as to effectively seal closed the outlet opening. With the outlet opening closed, the chamber of the pressure vessel can be pressurized to enable dispensing of fluid within the compartment of the media bag through the delivery tube.

The use of the interface adapter to seal closed the outlet opening provides a number of improvements over convention prior art methods. Most notably, no direct fluid communication is made with the pressure vessel. As such, it is not necessary to ensure that the pressure vessel is properly sterilized. Furthermore, since the media bag is never openly exposed to the environment during coupling with the pressure vessel, there is less chance of contaminating any fluid which may be positioned therein. Furthermore, the media bag and delivery tube can be inexpensively manufactured so as to be disposable after each use. As a result, time is not wasted during sterilization processes.

These and other objects, features, and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained will be understood, a more particular description of the invention briefly described above will be rendered by reference to a specific embodiment thereof which is illustrated in the appended drawings. Understanding that these drawings depict only a typical embodiment of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
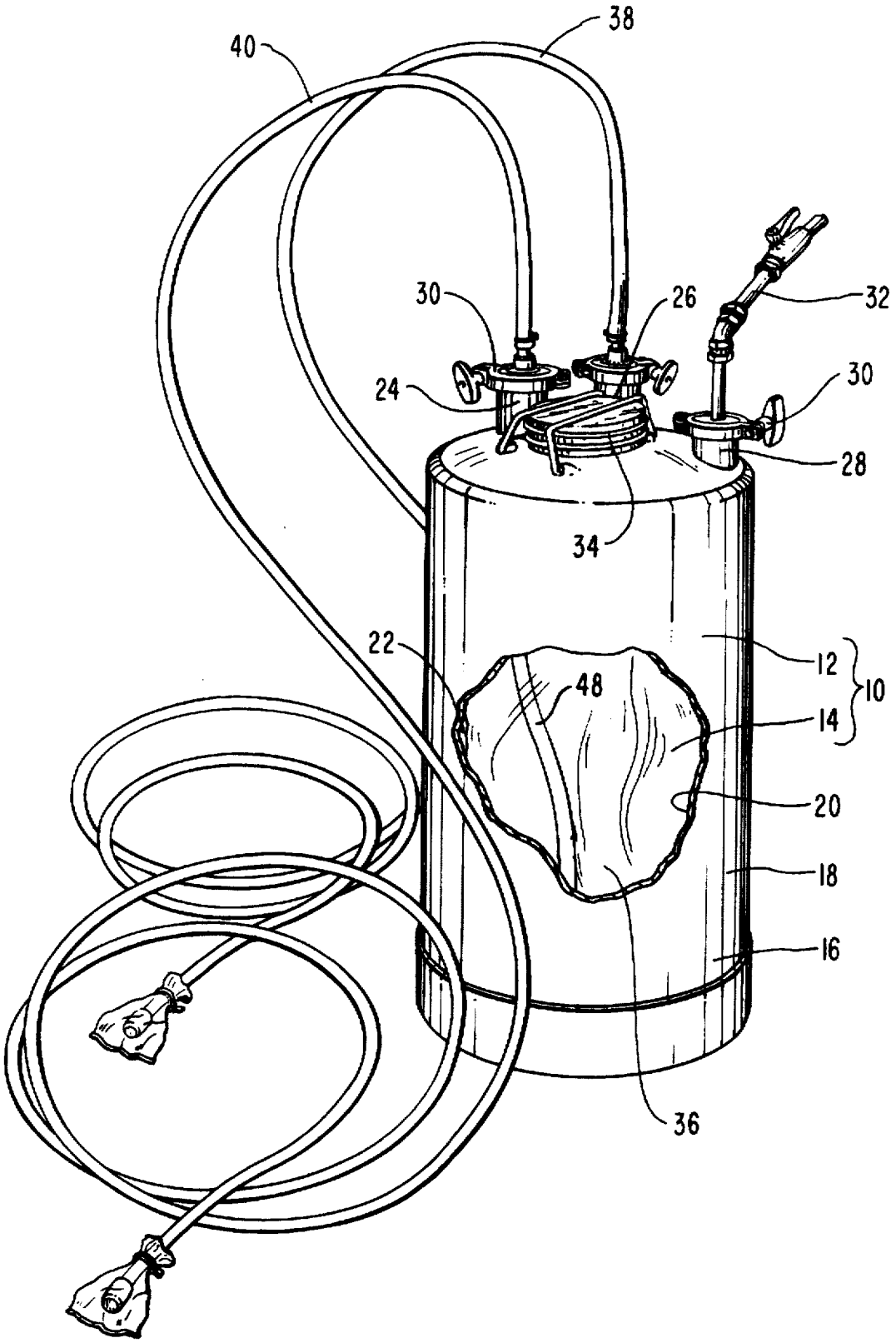
FIG. 1 is a perspective view of a fluid dispensing system including a pressure vessel and a fluid transport system interacting with the pressure vessel.

Depicted in FIG. 1 is a preferred embodiment of a fluid dispensing system 10 used for selectively dispensing a sterile fluid material at a desired flow rate. Fluid dispensing system 10 generally comprises a pressure vessel 12 and a fluid transport system 14 coupled with pressure vessel 12. As depicted in FIG. 1, pressure vessel 12 comprises a housing 16 having an exterior surface 18 and an interior surface 20. Interior surface 20 defines a chamber 22 formed within housing 16.

Projecting from housing 16 are a series of access ports 24, 26, and 28 each communicating with chamber 22. Selectively attached on each access port 24, 26, and 28 is a hinged clamp 30. Coupled with access port 28 by clamp 30 is a pressure supply line 32. Pressure supply line 32 is used for delivering a fluid such as air, water, or other gases or liquids into chamber 22 for selectively pressurizing chamber 22. Chamber 22 further comprises a hatch 34 which selectively closes an enlarged entree port that will be discussed later.

Figure 2:
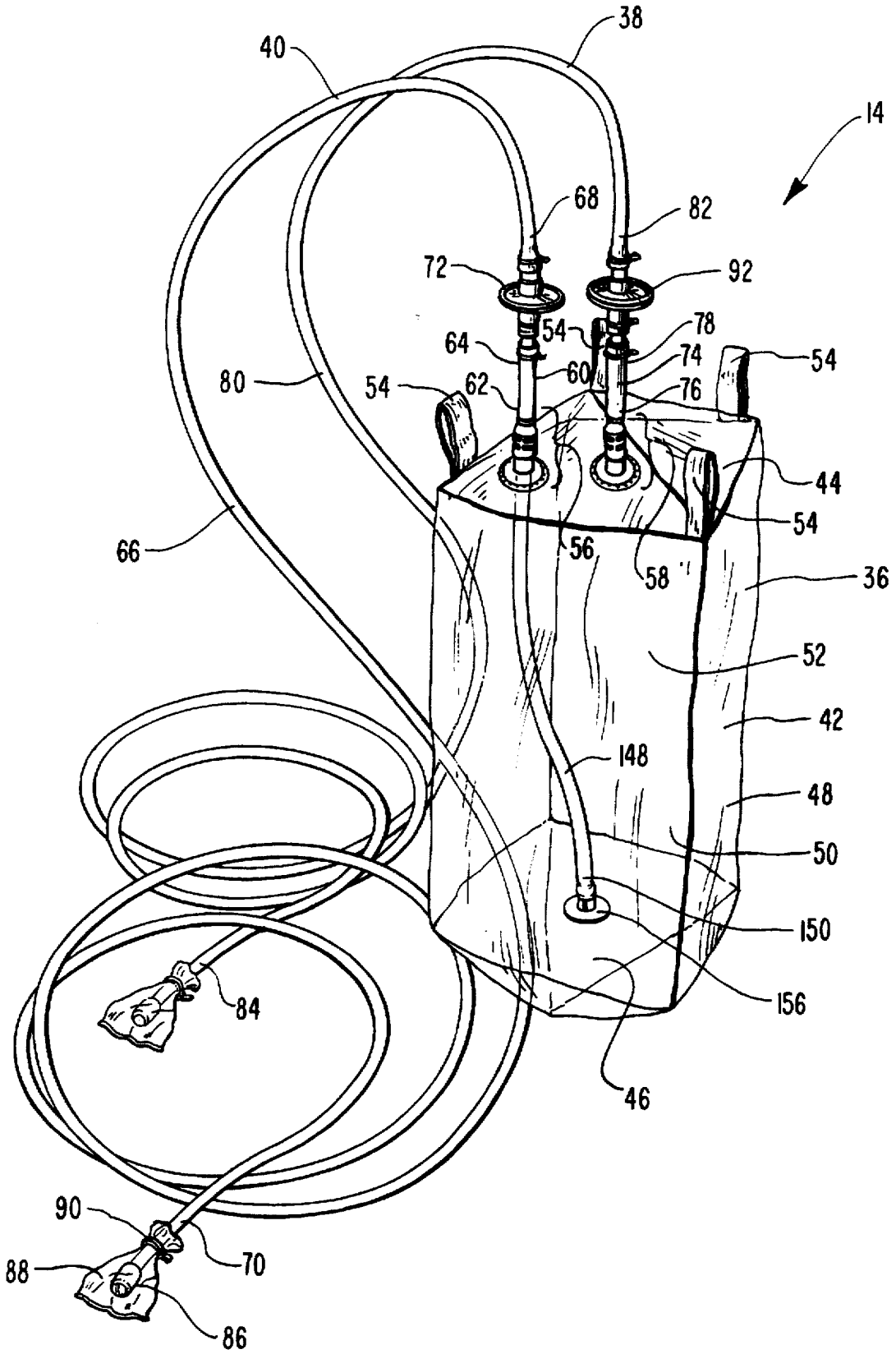
FIG. 2 is a perspective view of the fluid transport system shown in FIG. 1 including a collapsible media bag with a supply tube and a delivery tube communicating therewith.

Referring now to FIG. 2, fluid transport system 14 generally comprises a collapsible media bag 36, a supply tube 38, and a delivery tube 40. Media bag 36 comprises a body wall 42 having a top end 44, a bottom end 46, an exterior surface 48, and an interior surface 50. Interior surface 50 defines a compartment 52 enclosed within media bag 36. Attached to media bag 36 at top end 44 are four loop handles 54. Loop handles 54 can be used for attaching media bag 36 to interior surface 20 of pressure vessel 12. Also formed at top end 44 is a first coupling assembly 56 and a second coupling assembly 58. As will be discussed later in greater detail, coupling assemblies 56 and 58 are respectively used for attaching delivery tube 40 and supply tube 38 in fluid communication with compartment 52.

Body wall 42 of media bag 36 is preferably made of any thin, flexible plastic which can be used for storing chemicals, pharmaceutical fluids, biological fluids, or other fluids where the maintenance of a sterile environment is desired. Body wall 42 can comprise a single layer of material or, more preferably, a plurality of layers or liners. The multiple layers help to limit the potential of a leak which could contaminate the fluids positioned within media bag 36.

Delivery tube 40 has a lumen longitudinally extending therethrough and is depicted as comprising a transition tube 60 and a feeding tube 66. Transition tube 60 has a first end 62 attached to first coupling assembly 56 and an opposing second end 64. Feeding tube 66 has a first end 68 and an opposing free second end 70. Extending between first end 68 of feeding tube 66 and second end 64 of transition tube 60 is a first interface adapter 72 which will be discussed later in greater detail.

Similar to delivery tube 40, supply tube 38 also has a lumen extending therethrough and comprises a transition tube 74 and a source tube 80. Transition tube 74 further comprises a first end 76 attached to second coupling assembly 58 and a second end 78. Source tube 80 likewise has a first end 82 and an opposing free second end 84. As also will be discussed later in greater detail, a second interface adapter 92 is positioned between first end 82 of source tube 80 and second end 78 of transition tube 74.

Second end 84 of source tube 80 and second end 70 of feeding tube 66 are preferably manufactured so as to be hermetically sealed closed in a sterile condition. In one embodiment, a cap 86 is positioned over second end 70 while both cap 86 and a portion of second end 70 are received within a sterile bag 88. Bag 88 is sealed closed around feeding tube 66 by a plastic tie 90. Second end 84 of source tube 80 is sealed closed using substantially similar structure.

Since second end 84 of source tube 80 and second end 70 of feeding tube 66 are sealed closed, the lumens of supply tube 38 and delivery tube 40 in conjunction with compartment 52 of media bag 36 substantially define a closed sterile environment. As such, fluids can be delivered and removed from the closed sterile environment of fluid transport system 14 without compromising the sterile nature of the fluid.

Figure 3:
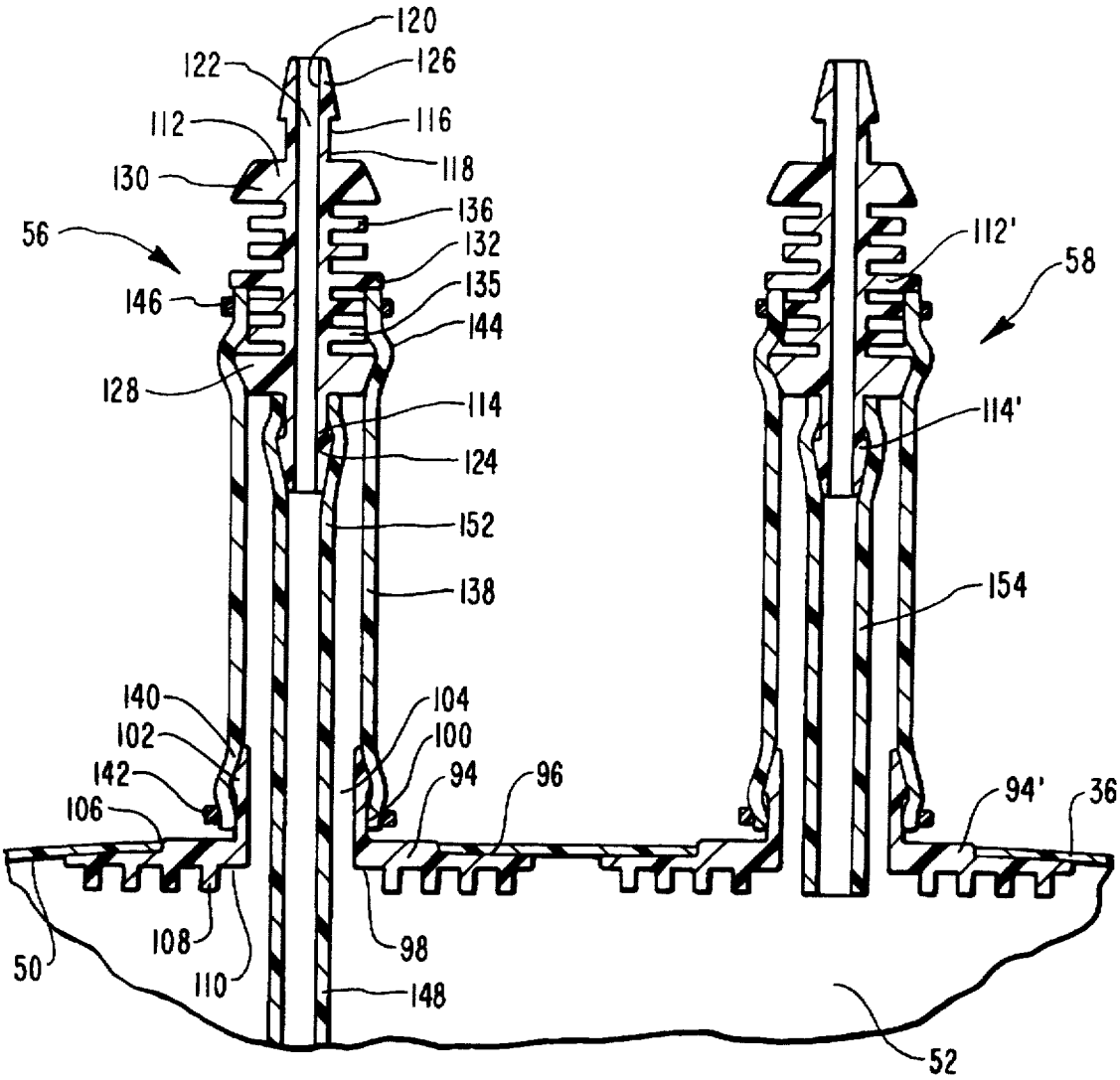
FIG. 3 is a cross-sectional side view of the top surface of the media bag shown in FIG. 2 where the supply tube and delivery tube attach therewith.

Referring now to FIG. 3, an enlarged cross-sectional view of first coupling assembly 56 and second coupling assembly 58 are attached to media bag 36. As depicted in FIG. 3, first coupling assembly 56 is substantially identical to second coupling assembly 58. Accordingly, the following description of the structure and assembly of first coupling assembly 56 is also applicable to second coupling assembly 58 unless otherwise noted. Second coupling assembly 58 will use the same reference characters with the addition of a prime symbol (') to identify structure on the second coupling assembly 58 that corresponds to structure on first coupling assembly 56.

First coupling assembly 56 is shown as comprising a circular port plate 94 having a top surface 96 and a bottom surface 98. Projecting from top surface 96 is a spout 100 having an exterior surface with an annular barb 102 encircling and radially projecting outward therefrom. Spout 100 further has an interior surface defining a passageway 104 extending therethrough.

Media bag 36 is initially formed with an aperture 106 extending therethrough. Prior to sealing compartment 52 closed, spout 100 is advanced from within compartment 52 through aperture 106. Top surface 96 of port plate 94 is then secured by conventional chemical or thermal methods against interior surface 50 of media bag 36.

To prevent body wall 42 of media bag 36 from collapsing against port plate 94 and sealing off passageway 104, a plurality of linear rids 108 project from bottom surface 98 of port plate 94. Ribs 108 define channels 110 which allow fluids to flow from within compartment 52 to passageway 104.

Figure 4:
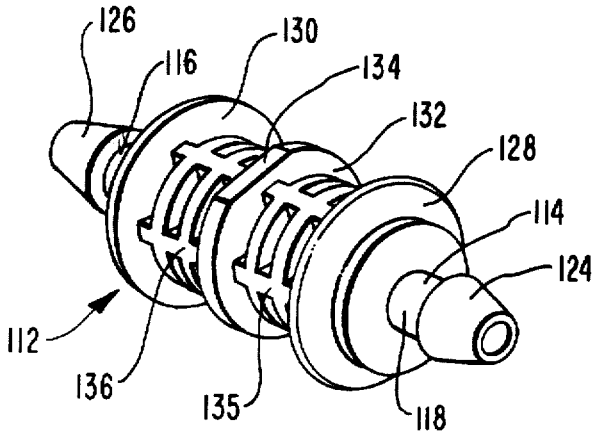
FIG. 4 is a perspective view of an enabling fitting used to attach the supply tube and delivery tube to the fluid media bag as shown in FIG. 3.

First coupling assembly 56 also includes an enabling fitting 112. As depicted in both FIG. 3 and FIG. 4, enabling fitting 112 has a first end 114, an opposing second end 116, and an exterior surface 118 extending therebetween. Enabling fitting 112 further includes an interior surface 120 defining a passageway 122 extending between first end 114 and second end 116. Encircling and radially extending out from exterior surface 118 at first end 114 and second end 116 is a pair of small diameter conical shaped barbs 124 and 126. Positioned between barbs 124 and 126 are a pair of large diameter barbs 128 and 130 which also encircle and radially extend out from exterior surface 118. Large diameter barbs 128 and 130 have an outside perimeter that is greater than the outside perimeter of small barbs 124 and 126.

Radially extending out from exterior surface 118 between large diameter barbs 128 and 130 is an enlarged stop plate 132. Stop plate 132 extends to an outside perimeter substantially equal to the outside perimeter of barbs 128 and 130. Stop plate 132 has a flattened edge 134 in order to provide a gripping surface for holding enabling fitting 112 with a tool for easy installation as well as to prevent fitting 112 from rolling on a flat surface.

Radially extending out from exterior surface 118 between barb 128 and stop plate 132 are a series of inner connecting ribs 135. In like manner, a series of inner connecting ribs 136 also radially extend out from exterior surface 118 between barb 130 and stop plate 132. Although the area covered by ribs 135 and 136 could be formed of a solid material, the formation of ribs 135 and 136 increases the ease of molding and reduces the amount of material needed for forming enabling fitting 112.

A cover tube 138 extends between enabling fitting 112 and spout 100 of port plate 94. More specifically, spout 100 is received within a first end 140 of cover tube 138 so that barb 102 radially biases against the interior surface of cover tube 138. Barb 102 is preferably configured to provide a sealed engagement with cover tube 138. To further facilitate the sealed engagement, a nylon cable tie 142 is snugly secured around first end 140 of cover tube 138 behind barb 102.

First end 114 of enabling fitting 112 is likewise received within a second end 144 of cover tube 138 so that barb 128 is received within cover tube 138 and cover tube 138 is biased against stop plate 132. Barb 128 is preferably configured to effect a sealed engagement with cover tube 138 when received therein. To further help ensure and maintain the effected seal, a cable tie 146 is snugly secured around second end 144 of cover tube 138 between stop plate 132 and barb 128.

To extract fluid from within media bag 36, a dip tube 148 has a first end 150 mounted to bottom end 46 of media bag 36, as shown in FIG. 2, and a second end 152 attached to enabling fitting 112, as shown in FIG. 3. Dip tube 148 is attached to enabling fitting 112 by advancing first end 114 of enabling fitting 112 into second end 152 of dip tube 148 so that barb 124 biases against the interior surface of dip tube 148 effecting a sealed engagement therewith.

The above described configuration of the first coupling assembly 56 allows the connection of dip tube 148 to enable fitting 112 without the need for a threaded fitting, insert fitting, complicated locking devices, O-rings, gaskets, or other sealing mechanisms, and without the need for an internal spout to be formed inside of media bag 36. This configuration alleviates leak problems of O-rings. Furthermore, port plate 94 is also more compatible with existing configurations in the industry and may be accessed in the field in a sterile, simple, and inexpensive manner.

Second end 116 of enabling fitting 112 can next be secured to first end 62 of transition tube 60 by advancing second barb 126 into first end 62 of transition tube 60. Again, barb 126 is configured to radially biased against the interior surface of transition tube 60 to form a sealed engagement therebetween. To help maintain the sealed engagement a nylon cable tie can also be secured around transition tube 60 behind barb 126.

First coupling assembly 56 is discussed in greater detail in U.S. patent application Ser. No. 08/331,696, filed Oct. 31, 1995 now U.S. Pat. No. 5,687,993 and entitled Dual Containment System for Transferring Sterile Fluids to and From a Container. For purpose of disclosure, the above referenced patent application is incorporated herein by specific reference.

Second coupling assembly 58 is constructed and configured substantially identical to that of first coupling assembly 56 but is used for selective attachment to transition tube 74.

Furthermore, rather than having a dip tube 148 that extends to bottom end 46 of media bag 36, second coupling assembly 58 has a relatively short tube 154 that is attached to first end 114' of an enabling fitting 112'. Tube 154 extends from the attachment at first end 114' to slightly within compartment 52 at port plate 94'. The contrast between tube 154 and dip tube 148 is that tube 154 is used for delivering fluid into compartment 52 whereas dip tube 148 is used for withdrawing fluid from compartment 52. Accordingly, dip tube 152 is preferably attached to bottom end 46 of media bag 36 to allow all the fluid to be removed from media bag 36.

Figure 5:
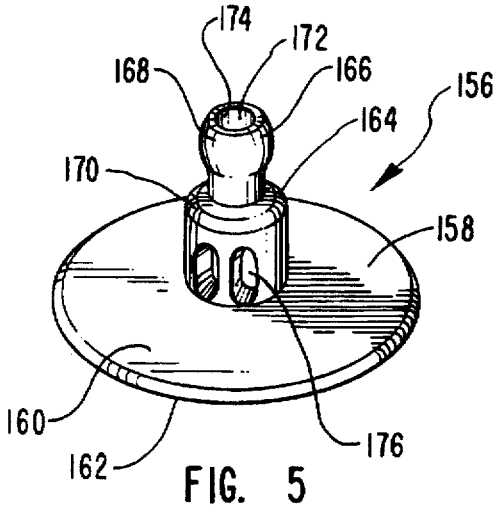
FIG. 5 is a perspective view of an anchor for attaching a dip tube to the interior surface of the media bag shown in FIG. 2.

Referring again to FIG. 2, first end 150 of dip tube 148 is attached to bottom end 46 of media bag 36 by an anchor 156. Anchor 156, as depicted in FIG. 5, comprises a mounting plate 158 having a top surface 160 and a bottom surface 162. A spout 164 projects from top surface 160 to an attachment end 166. Encircling and radially extending out from spout 164 at end 166 is an annular ring 168. Also encircling and radially extending out from spout 164 is a shoulder 170. Shoulder 170 is positioned between ring 168 and mounting plate 158. Spout 164 also has an interior surface 172 that defines a passageway 174 extending from an attachment end 166 to mounting plate 158. Finally, a plurality of side ports 176 extend through spout 164 near mounting plate 158 so as to communicate with passageway 174.

During use, anchor 156 is initially secured to media bag 36 by using conventional chemical or thermal processes to adhere bottom surface 162 of mounting plate 158 to bottom end 46 of media bag 36. Attachment end 166 of spout 164 is then received within first end 150 of dip tube 148. Ring 168 is configured to radially bias against the interior surface of dip tube 148 to make a sealed connection therebetween. Shoulder 170 of spout 164 acts as a stop for dip tube 148 so that side ports 176 are not covered by dip tube 148. In this configuration, dip tube 148 is secured to the bottom of media bag 36 to enable fluid thereat to flow through side ports 176 and into dip tube 148.

Referring back to FIG. 1, fluid dispensing system 10 generally operates by initially connecting second end 84 of supply tube 38 to a source of serial fluid material. Supply tube 38 preferably has a length to permit second end 84 to be connected to a fluid source under a clean laminar hood. This enables cap 86 and bag 88 to be removed from second end 84 and second end 84 to be attached to the fluid source without compromising the enclosed sterile environment of fluid transport system 14. Furthermore, it is also preferred that supply tube 38 be sufficiently long to connect to the fluid source without having to move pressure vessel 12. This is beneficial in that conventional pressure vessels, depending on their size, shape, and location, may be difficult if not impossible to move. Once second end 84 is attached to a sterile fluid source, the fluid is permitted to flow through supply tube 38 and into media bag 36 which is positioned within chamber 22 as shown in FIG. 1.

Next, second end 70 of delivery tube 40 is likewise positioned within some form of a clean laminar hood were it is typically connected under sterile conditions to some form of a nozzle having a flow regulating valve attached thereto. Here again it is beneficial to that delivery tube 40 be sufficiently long so that second end 70 can be positioned within the laminar hood without having to move pressure vessel 12.

Once the nozzle is attached to second end 70 of delivery tube 40, a fluid is passed through pressure supply line 32 into chamber 22 of pressure vessel 12 so as to pressurize chamber 22. The pressure produced within chamber 22 produces a compressive force on media bag 36. Accordingly, as the flow regulating valve attached to delivery tube 40 is opened, media bag 36 begins to collapse causing the sterile fluid contained therein to enter dip tube 148, travel through delivery tube 40, end exit at the nozzle attached thereto. The rate at which the sterile fluid exits delivery tube 40 depends on how much pressure is within chamber 22. The pressure can be regulated by a pressure regulating valve attached to pressure supply line 32.

Fluid dispensing system 10 can also operate without the use or presence of supply tube 38. This is accomplished by using delivery tube 40 to both fill compartment 52 of media bag 36 with the sterile fluid and then subsequently dispense the fluid to the desired location as a result of pressure applied to bag 36.

Figure 6:
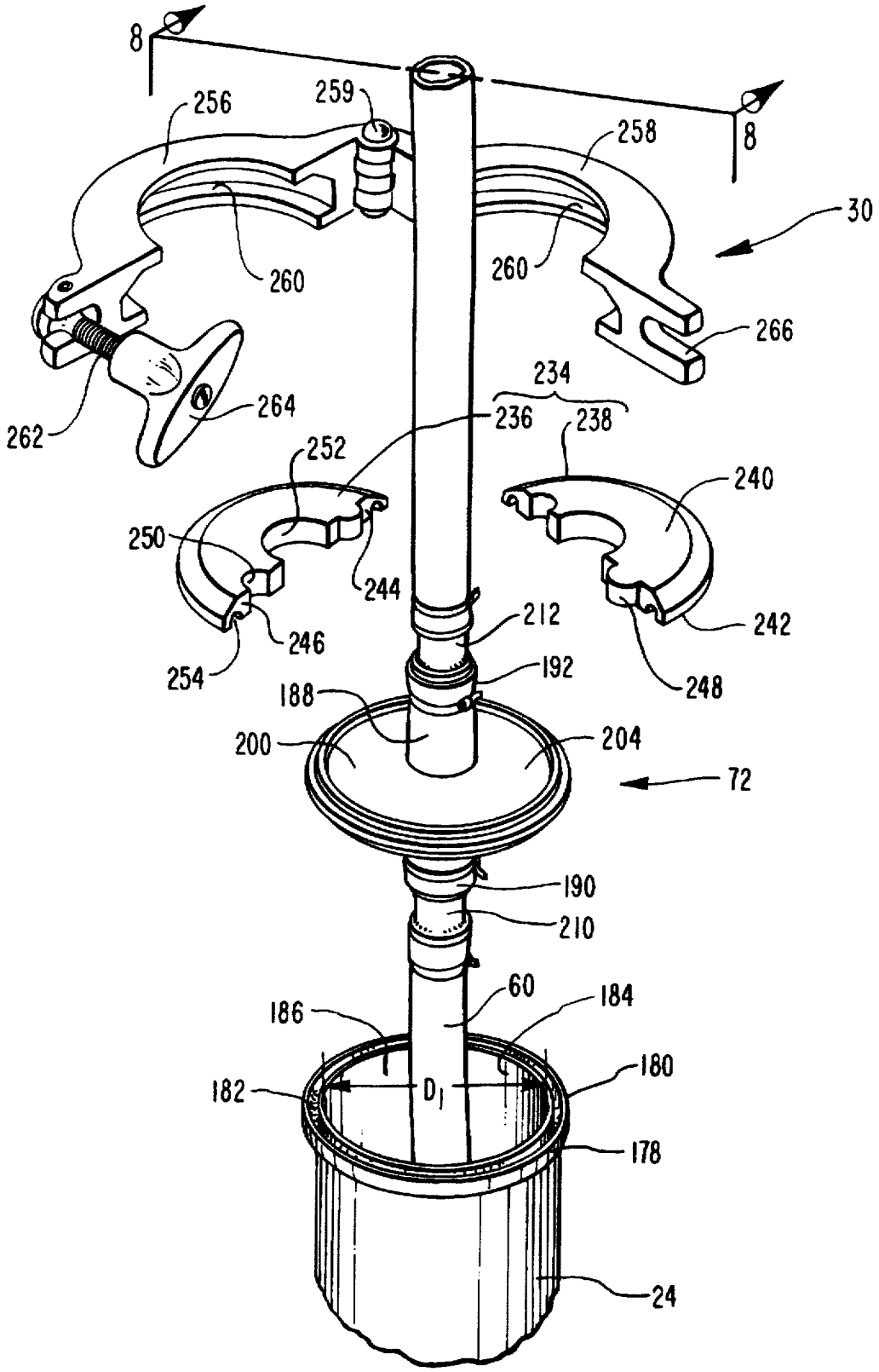
FIG. 6 is an exploded view of an assembly for attaching an interface adapter shown in FIG. 2 to the pressure vessel shown in FIG. 1.

To enable chamber 22 to be pressurized, however, it is necessary that access ports 24 and 26 in which delivery tube 40 and supply tube 38 are selectively disposed, be sealed closed. Furthermore, access ports 24 and 26 must be sealed closed without breaching the sterile environment within fluid transport system 14. To effect the seal of access ports 24 and 26, an assembly is used as depicted in FIG. 6. Although the assembly shown in FIG. 6 shall be specifically discussed with regard to the interaction between access port 24 and delivery tube 40, the structural elements and assembly are substantially identical to those used for sealing access port 26.

As depicted in FIG. 6, access port 24 has a sealing flange 178 formed at the end thereof. Sealing flange 178 has an exposed face 180 within annular groove 182 formed thereon. Access port 24 is further shown as having an interior surface 184 defining an outlet opening 186 that communicates with chamber 22 of pressure vessel 12. Outlet opening 186 has an inside diameter $D_1$.

Figure 7A:
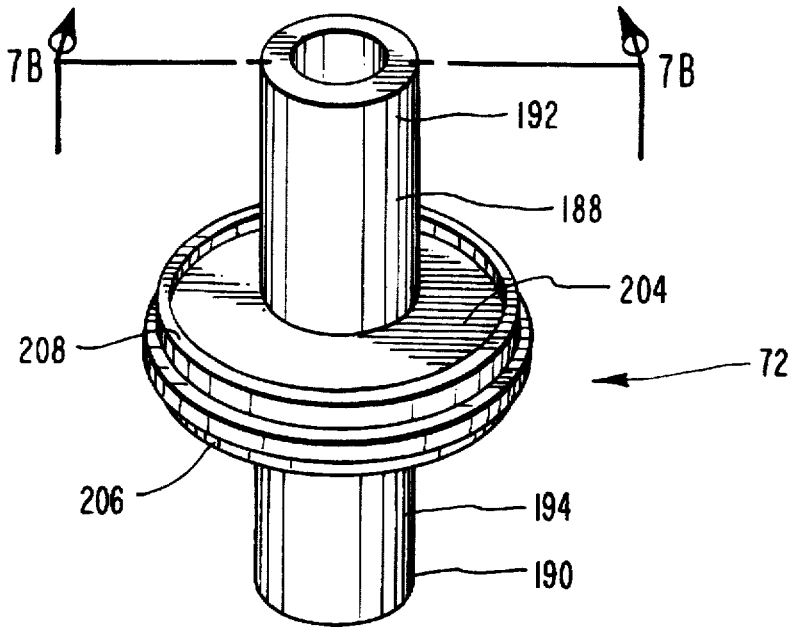
FIG. 7A is a perspective view of the interface adapter shown in FIG. 6.
Figure 7B:
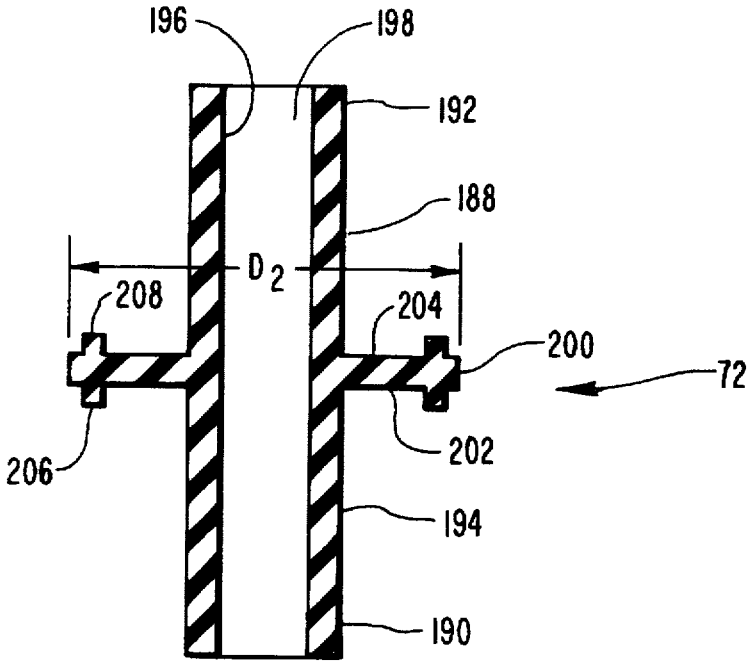
FIG. 7B is a cross-sectional side view of the interface adapter shown in FIG. 7A.

Transition tube 60 is shown as extending through outlet opening 186 so that first interface adapter 72 is vertically elevated above access port 24. As better depicted in FIGS. 7A and 7B, first interface adapter 72 preferably comprises a tubular sleeve 188 having a first end 190, an opposing second end 192, and an exterior surface 194 extending therebetween. Tubular sleeve 188 further includes an interior surface 196 which defines a passageway 198 longitudinally extending between first end 190 and second end 192. Encircling and radially projecting out from exterior surface 194 of tubular sleeve 188 is an annular gasket 200 having an outside diameter $D_2$. It is noted that outside diameter $D_2$ of annular gasket 200 is greater than inside diameter $D_1$ of outlet opening 186. Gasket 200 has a first side 202 and an opposing second side 204. Radially projecting out from first side 202 so as to encircle tubular sleeve 188 is an annular first ridge 206. Likewise, projecting out from second side 204 so as to encircle tubular sleeve 188 is an annular second ridge 208.

Figure 8:
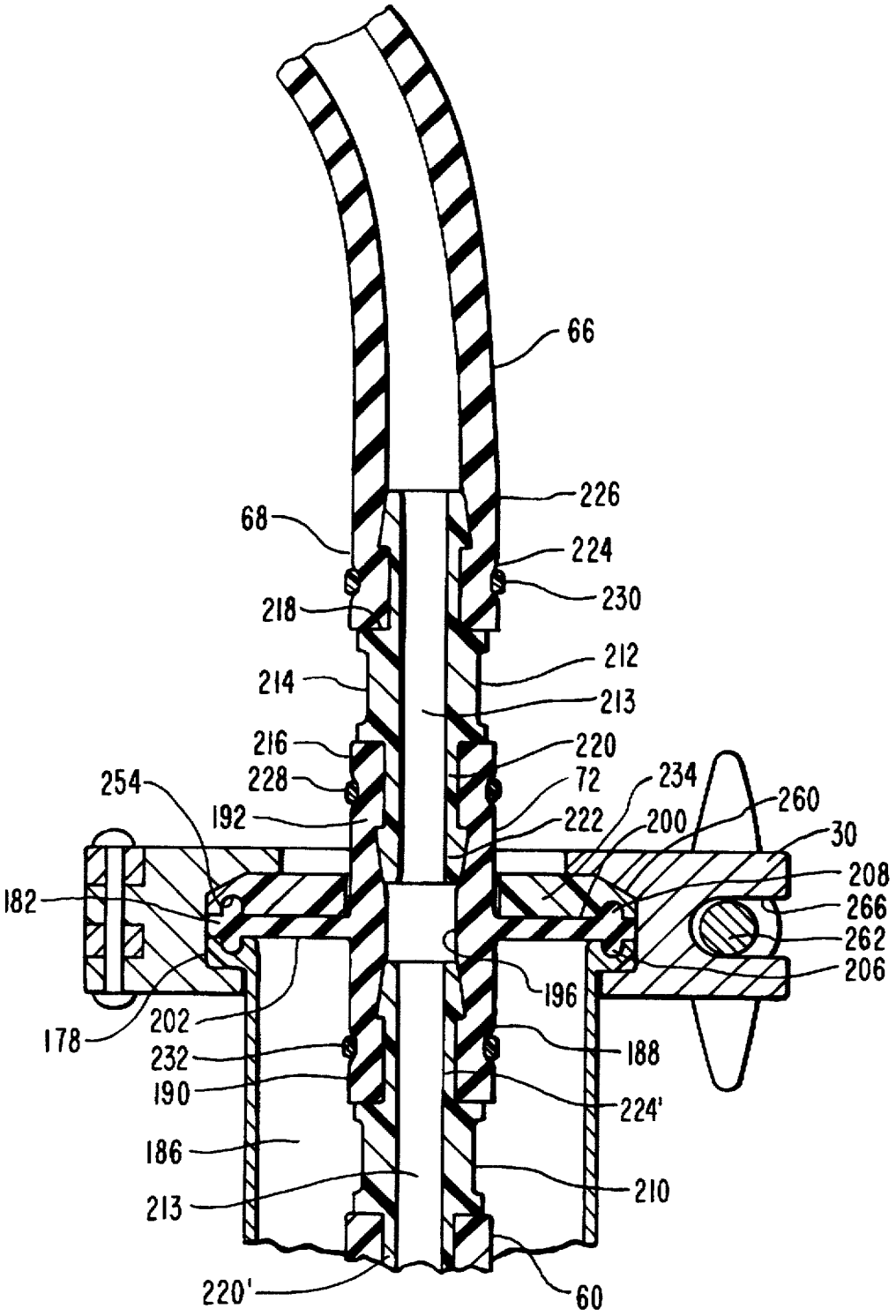
FIG. 8 is a cross-sectional side view of the assembled structure shown in FIG. 6 taken along section lines 8—8 thereof.

As best depicted in FIG. 8, first interface adapter 72 is preferably fluid coupled to transition tube 60 and feeding tube 66 by a pair of barbed adapters 210 and 212 each having a passageway 213 extending therethrough. Adapter 212 is shown as having a substantially cylindrical body 214 having opposing end faces 216 and 218. Extending from end face 216 is a first stem 220 having an annular barb 222 encircling and radially projecting out therefrom. Likewise, projecting from end face 218 is a second stem 224 having an annular barb 226 encircling and radially projecting out therefrom.

During assembly, first stem 220 of barb adapter 212 is received within second end 192 of first interface adapter 72. Barb 222 is configured to radially bias against interior surface 196 of first interface adapter 72 to form a sealed connection therewith. To farther effect the seal and to ensure that barbed adapter 212 does not disconnect from interface adapter 72, a nylon cable tie 228 is secured around interface adapter 72 having first stem 220 received therein. Second stem 224 of barb adapter 220 is likewise received and secured within first end 68 of feeding tube 66 to form a sealed fluid coupling therewith. A nylon cable tie 230 is likewise shown as securely holding feeding tube 66 to barbed adapter 212.

Barbed adapter 210 has an identical configuration to barbed adapter 212. As such, the same reference characters identifying the structure elements of barbed adapter 212 are also used, with the addition of the prime symbol (′), to reference the structural elements of barbed adapter 210. As shown in FIG. 8, second stem 224′ of adapter 210 is inserted within first end 190 of first interface adapter 72 to form a sealed fluid coupling therewith. A nylon cable tie 232 is secured around interface adapter 72 to further affect the seal. Likewise, first stem 220′ is received within second end 64 of transition tube 60 to affect a sealed coupling therewith.

As a result of the attachments of barbed adapters 210 and 212, a sealed fluid flow pathway extends from transition tube 60 through first interface adapter 72 and into feeding tube 66.

To seal outlet opening 186 of access port 24 closed, first side 202 of gasket 200 is biased against sealing flange 178 so that annular ridge 206 is received within annular groove 182. In this configuration, outlet opening 186 is effectively sealed closed by gasket 200. However, gasket 200 is unable to maintain outlet opening 186 closed in the presence of applied pressure from chamber 22. To firmly secure gasket 200 to sealing flange 178, a compression plate 234 is used in conjunction with hinged clamp 30.

Referring to FIG. 6, compression plate 234 comprises a pair of interlocking C-shaped plates 236 and 238. Each C-shaped plate 236 and 238 has a top surface 240 and an opposing bottom surface 242. Furthermore, each C-shaped plate 236 and 238 has a pair of opposing end faces 244 and 246. Each end face 244 and 246 has either a ridge 248 or a complimentary groove 250 formed thereon so as to properly align and interlock opposing end faces 244 and 246 of each C-shaped plate 236 and 238.

Each C-shaped plate 236 and 238 also has a semi-circular slot 252 extending therethrough. Each slot 252 is configured to encircle tubular sleeve 188 when C-shaped plates 236 and 238 are mounted on second side 204 of gasket 200. Furthermore, each C-shaped plate 236 and 238 has an annular recess 254 formed on bottom surface 242 around the outside parameter. As depicted in FIG. 8, recess 254 is configured to receive ridge 208 on gasket 200. In this configuration, compression plate 234 functions both to assist in securing gasket 200 against sealing flange 178 and also provides support for the portion of gasket 200 extending between sealing flange 178 and tubular sleeve 188 which is subject to the pressure within chamber 22.

With gasket 200 sandwiched between sealing flange 178 and compression plate 234, hinged clamp 30 can be attached thereto for securely holding gasket 200 in place. As depicted in FIG. 6, clamp 30 comprises a pair of C-shaped hands 256 and 258 that are connected by a hinge 259. Hand 256 also has a threaded bolt 262 with a handle 264 threadedly attached thereto. Hand 258 has a corresponding slot 266 formed thereat to receive bolt 262. Rotation of handle 264 with bolt 262 received within slot 266 results in clamping hands 256 and 258 together.

Each of hands 256 and 258 also have complimentary shaped recessed mouths 260. As depicted in FIG. 8, mouths 260 are configured to receive gasket 200 sandwiched between sealing flange 178 and compression plate 234. By securing bolt 262 within slot 266 as shown in FIG. 8, clamp 30 seals and securely holds gasket 200 to sealing flange 178, thereby sealing outlet opening 186 to enable pressurization of chamber 22.

Figure 11A:
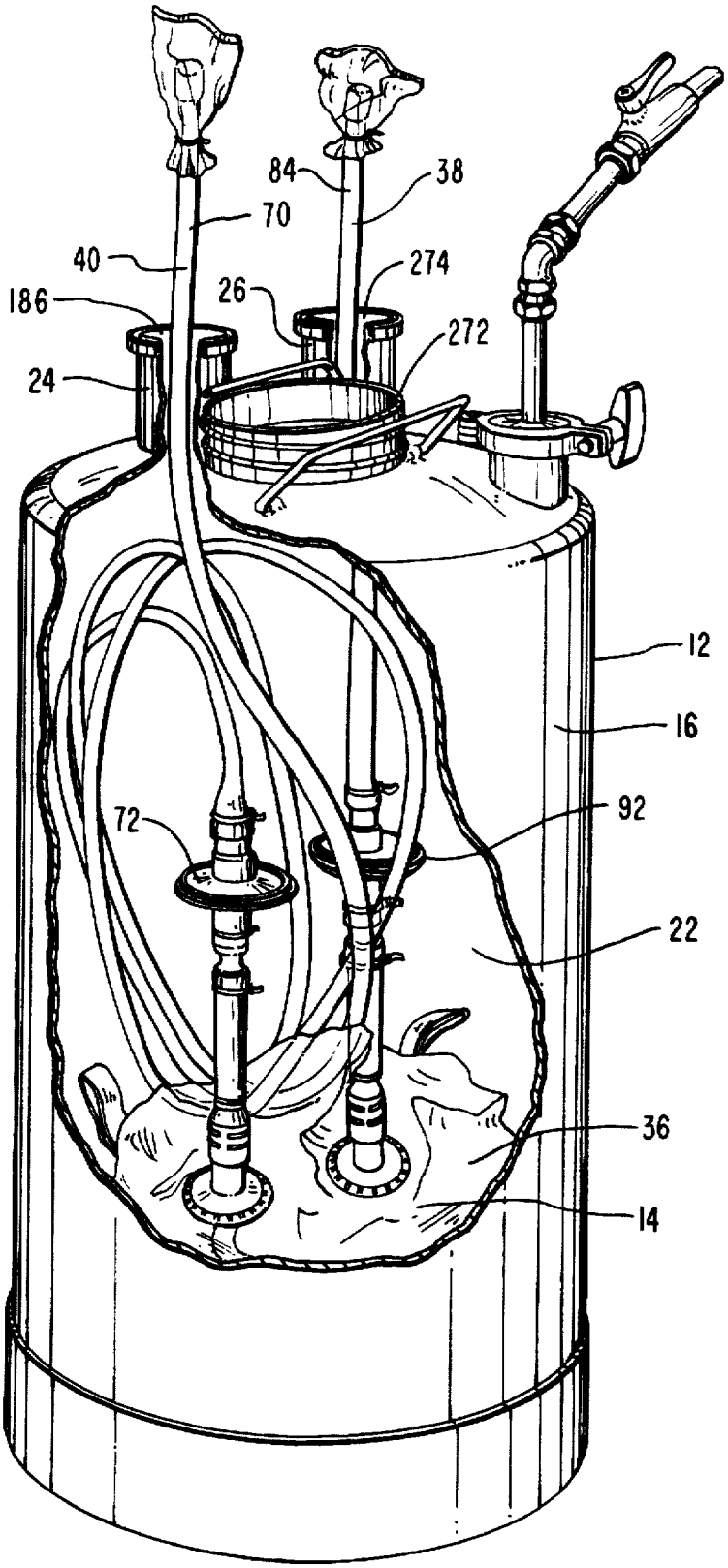
FIGS. 11A–11C are partial cutaway perspective views showing the sequential steps used in attaching the interface adapter shown in FIG. 7A to the pressure vessel shown in FIG. 1.

The present invention also provides first sealing means disposed at a point along delivery tube 40. The first sealing means is for effecting a pressure-tight seal of outlet opening 186 without breaching the closed sterile environment of fluid transport system 14. This enables pressurization of chamber 22 when media bag 36 is positioned within chamber 22 of pressure vessel 12 and second end 70 of delivery tube 40 is passed from within chamber 22 through outlet opening 186 so as to be outside of pressure vessel 12, as shown in FIG. 11A.

Figure 9:
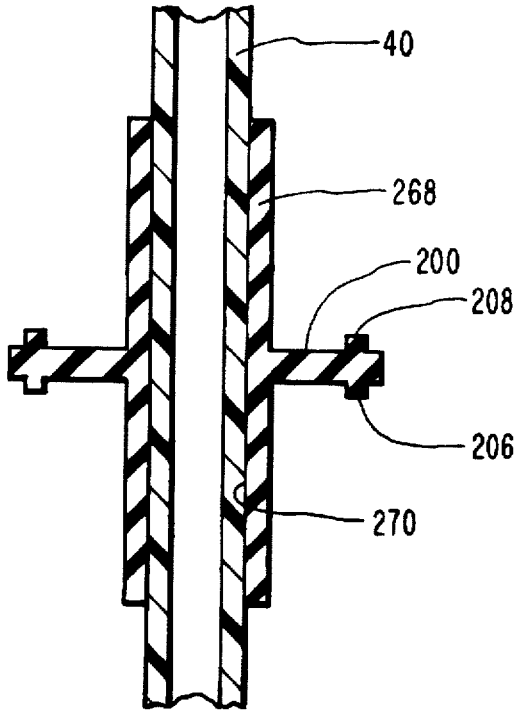
FIG. 9 is a cross-sectional side view of an alternative embodiment of the interface adapter shown in FIG. 7A.

By way of example and not by limitation, one embodiment of the first sealing means comprises first interface adapter 72 that, as previously discussed with regard to FIGS. 6–8, is selectively used for sealing closed outlet opening 186. The present invention also envisions a variety of alternative structures that likewise perform the function of the first sealing means. By way of example and not by limitation, depicted in FIG. 9 is an interface adapter 268 that is an alternative embodiment of first interface adapter 72. Interface adapter 268 has an interior surface 270 that is sized to receive delivery tube 40 therein. Such a configuration eliminates the need for the use of barbed adapters 210 and 212. This is because interface adapter 270 is not spliced between sections of delivery tube 40 but is rather positioned around the exterior surface of delivery tube 40. Since there are fewer connections, the potential for leaking is also minimized.

For the embodiment shown in FIG. 9 to work, however, there must be a fluid-tight seal between interior surface 270 of interface adapter 268 and the exterior surface of delivery tube 40. This can be accomplished by using conventional chemical or thermal bonding between the two components. Alternatively, various forms of shrink-fitting or compression-fitting can also be used to form a sufficiently secure seal therebetween. Interface adapter 268 is also shown as comprising a gasket 200 having ridges 206 and 208 projecting therefrom as previously discussed with regard to first interface adapter 72.

Figure 10:
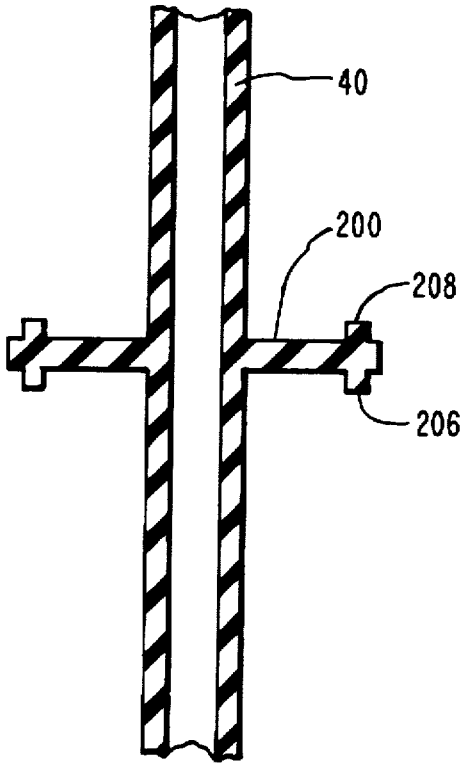
FIG. 10 is a cross-sectional side view of an alternative embodiment of the interface adapter shown in FIG. 7A.

Depicted in FIG. 10 is yet another alternative embodiment of the first sealing means. As disclosed therein, delivery tube 40 or at least a portion of delivery tube 40 can be directly molded having gasket 200 radially extending from the exterior surface thereof. Gasket 200 would likewise have ridges 208 and 206 projecting therefrom as previously discussed with first interface adapter 72. This embodiment also eliminates the needs for barbed adapters 210 and 212 and significantly reduces the number of connections thereby, decreasing the possibility of leaking or contamination of the sterile fluid.

Using the same procedure as discussed above with regard to first interface adapter 72, second interface adapter 92 used in conjunction with a compression plate 234 and a clamp 30 can be used for sealing closed an inlet opening 274, shown in FIG. 11A, extending through access port 26. One embodiment of the present invention also provides second sealing means disposed at a point along supply tube 38. The second sealing means is for effecting a pressure tight seal of inlet opening 274 extending through access port 26 without breaching the closed sterile environment of fluid transport system 14. This enables pressurization of chamber 22 when media bag is positioned with chamber 22 of pressure vessel 12 and second end 64 of supply tube 40 is passed within chamber through inlet opening 274 so as to be outside of pressure vessel 12.

By way of example and not by limitation, one embodiment of the second sealing means comprises second interface adapter 92 which has the same structural elements as interface adapter 72 discussed above. Alternative embodiments of the second sealing means also include the alternative interface adapters previously discussed with regard to FIGS. 9 and 10.

The present invention also provides containment means attached in sealed fluid communication with first end 70 of delivery tube 40 for forming a closed sterile environment capable of receiving and containing a fluid and for dispensing the contained fluid through delivery tube 40 when pressure is applied to the containment means. By way of example and not by limitation, one embodiment of the containment means comprises media bag 36 as previously discussed with regard to FIG. 2. Media bag 36 has a compartment 52 which in part defines a closed sterile environment capable of receiving and containing a fluid. Furthermore, media bag 36 is made of a flexible material which is collapsible when pressure is applied thereto so as to dispense the fluid contained within compartment 52 into delivery tube 40.

The present invention also envisions a variety of alternative structures which likewise perform a containment means. By way of example, a fluid bag could be provided having a variety of alternative shapes. In addition, the media bag could be semi-rigid to provide directional collapsing, such as if the bag had an accordion configuration, or partially collapsible, such as if a portion of the bag was rigid while another portion was collapsible.

In another aspect of the present invention, first attachment means are provided for removably securing first interface adapter 72 to housing 16 of pressure vessel 12. One embodiment of the attachment means comprises sealing flange 178 interacting with clamp 30 and compression plate 324 as previously discussed with regard to FIGS. 6 and 8, to removably secure interface adapter 72 to access port 24.

The present invention also provides clamping means for compressing interface adapter 72 against sealing flange 178 to produce a pressure tight seal therebetween. One example of the clamping means comprises clamp 30 as previously discussed with FIGS. 6 and 8. There are, of course, a variety of alternative clamping structures that the present invention also envisions.

Finally, the present invention also envisions anchoring means for securing first end 150 of dip tube 148 to bottom end 46 of media bag 36. The anchoring means is configured to enable fluid to enter the first end 150 of dip tube 148 at bottom end 46. By way of example and not by limitation, one example of the anchoring means comprises anchor 156 as previously discussed with regard to FIGS. 2 and 5.

Figure 11B:
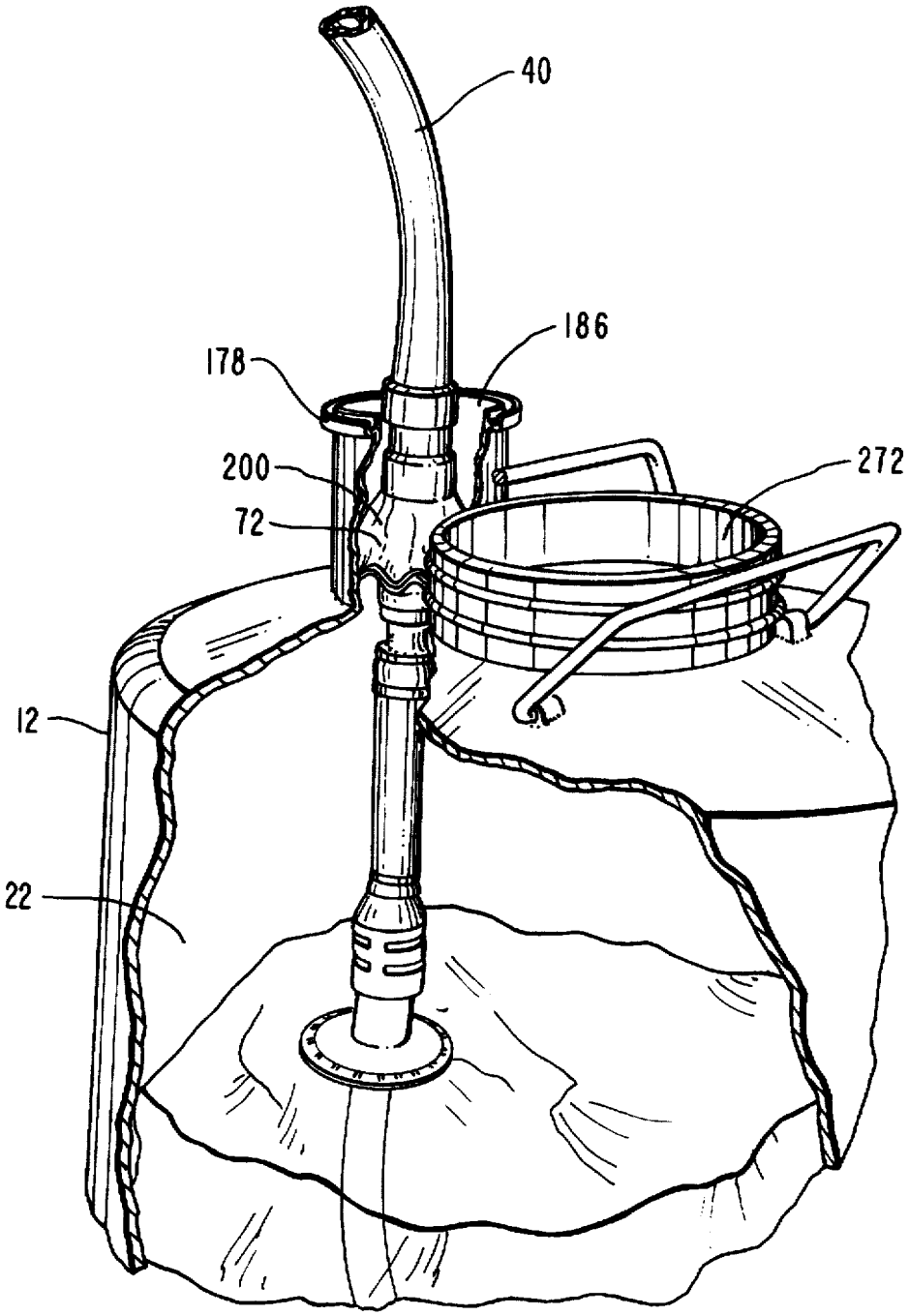
Figure 11C:
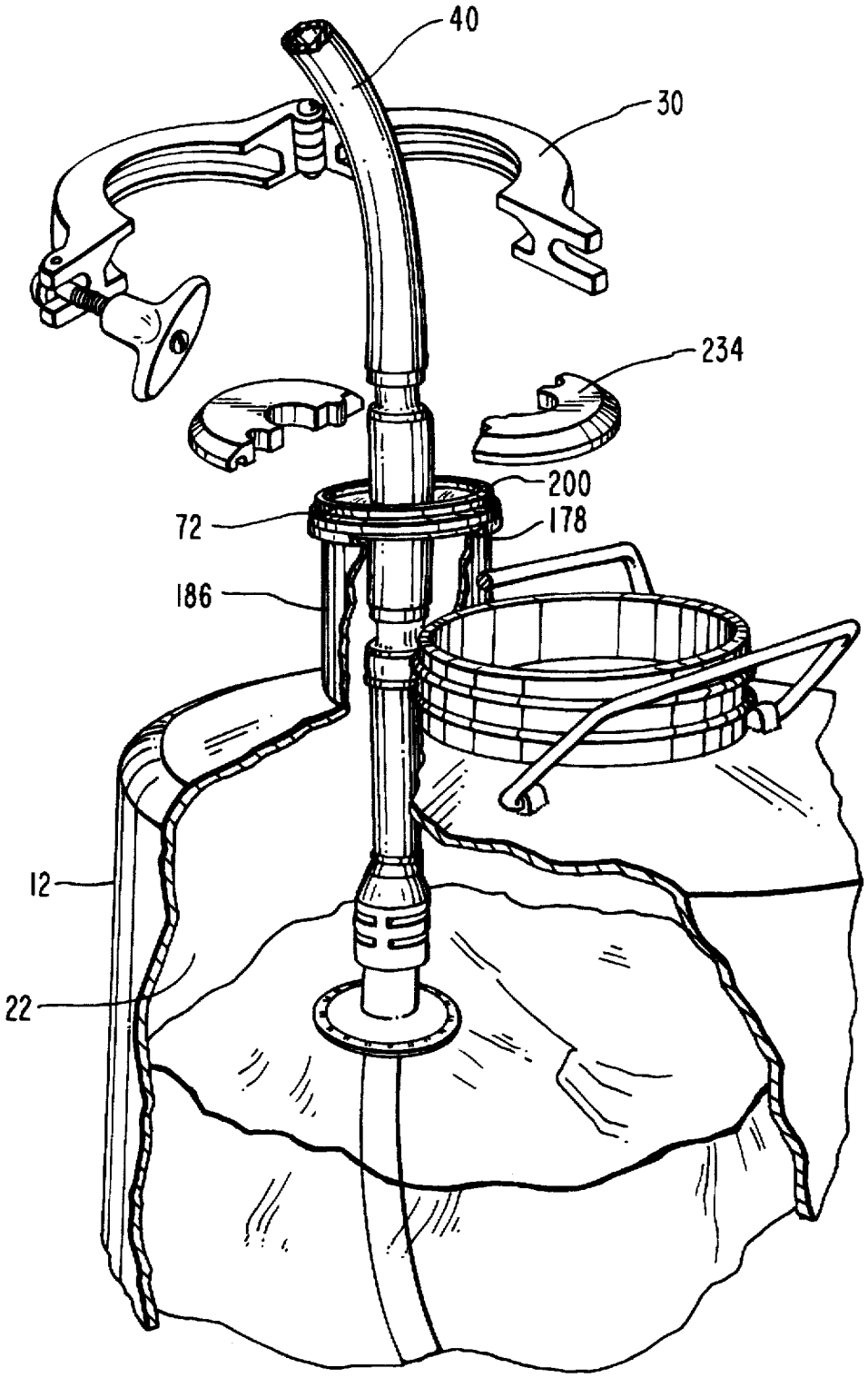

FIGS. 11A–11C disclose a series of sequential steps which are used in coupling fluid transport system 14 to pressure vessel 12. Initially, as depicted in FIG. 11A, transport system 14, including media bag 36, delivery tube 40, and supply tube 38, is passed through an enlarged entree port 272 on housing 16 so as to be disposed within chamber 22. Next, second end 70 of delivery tube 40 and second end 84 of supply tube 38 are passed from within chamber 22 through corresponding access ports 24 and 26 so as to be positioned outside of pressure vessel 12. Delivery tube 40 is continually withdrawn from within chamber 22 through access port 24 until first interface adapter 72 is positioned at access port 24. As previously discussed, outlet opening 186 of access port 24 has an inside diameter that is slightly smaller than the outside diameter of first interface adapter 72. However, first interface adapter 72 is made of a flexible material, such as silicone or rubber, which enables first interface adapter 72 to be constricted so as to be pulled through access port 24 as shown in FIG. 11B.

Once first interface adapter 72 passes through outlet opening 186, gasket 200 can be radially outwardly expanded so as to be interconnected with sealing flange 178 as previously discussed with regard to FIG. 8 and as shown in FIG. 11C. In this position, compression plate 234 and hinged clamp 30 can also be attached as previously discussed with FIG. 8 so as to seal outlet opening 186 closed.

The same process can then be used for sealing closed access port 26 with second interface adapter 92 and clamp 30.

The present invention thus provides a variety of improvements over the prior art. For example, fluid transport system 14 of the present invention can be coupled with pressure vessel 12 without requiring direct fluid communication therebetween. As a result, there is no need for repeated cleaning and sterilizing of the pressure vessel. Furthermore, since there is no direct fluid communication between the pressure vessel and fluid transport system, the likelihood of contamination of the fluid traveling through the fluid transport system is substantially decreased. Furthermore, fluid transport system 14 can be manufactured as a single unit at a relatively inexpensive cost. As such, fluid transport system 14 can be disposed of after use, thereby minimizing sterilizing costs.

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A fluid transport system for selectively dispensing a fluid from within a pressure vessel, the pressure vessel comprising a housing having an interior surface defining a chamber, the pressure vessel further comprising an outlet opening having an inner diameter and being formed on the housing and an inlet opening having an inner diameter and being formed on the housing, the inlet opening and the outlet opening each effecting discrete fluid communication between the chamber of the pressure vessel and the exterior of the pressure vessel, the fluid transport system comprising:

(a) a delivery tube comprising a first end, an opposing second end being sealed closed, an exterior surface, and an interior surface defining a lumen extending between the first end and the second end;

(b) containment means attached in sealed fluid communication with the first end of the delivery tube for forming a closed sterile environment capable of receiving and containing a fluid and for dispensing the contained fluid through the delivery tube when pressure is applied to the containment means; and (c) first sealing means disposed at a point along the delivery tube for effecting a pressure tight seal of the outlet opening without breaching the closed sterile environment of the containment means to enable pressurization of the chamber of the pressure vessel when the containment means is positioned within the chamber and the second end of the delivery tube is passed from within the chamber though the outlet opening so as to be outside of the pressure vessel.

2. A fluid transport system as recited in claim 1, wherein the sealing means comprises a gasket encircling and radially extending out from the exterior surface of the delivery tube, the gasket extending to an outside perimeter that is larger than the inner diameter of the fluid outlet opening, the gasket being sufficiently flexible to pass through the outlet opening.

3. A fluid transport system as recited in claim 2, wherein the gasket is integrally formed with the delivery tube.

4. A fluid transport system as recited in claim 2, wherein the gasket is secured to the exterior surface of the delivery tube.

5. A fluid transport system as recited in claim 2, wherein the gasket has a first side with an annular ridge projecting therefrom and encircling the delivery tube.

6. A fluid transport system as recited in claim 5, wherein the gasket has a second side with an annular ridge projecting therefrom and encircling the delivery tube.

7. A fluid transport system as recited in claim 1, wherein the sealing means comprises:

(a) a tubular sleeve having an exterior surface and being fluid coupled in axial alignment with the delivery tube at a point between the first end and the second end of the delivery tube; and (b) a gasket encircling and radially extending out from the exterior surface of the tubular sleeve, the gasket extending to an outside perimeter that is larger than the inner diameter of the outlet opening, the gasket being sufficiently flexible to pass through the outlet opening.

8. A fluid transport system as recited in claim 7, wherein the gasket has a first side with an annular ridge projecting therefrom and encircling the delivery tube.

9. A fluid transport system as recited in claim 1, wherein the containment means comprises a collapsible media bag having an interior surface defining a compartment for containing a fluid.

10. A fluid transport system as recited in claim 9, wherein the media bag comprises a plurality of liners.

11. A fluid transport system as recited in claim 9, further comprising a dip tube having:

(a) the first end disposed within a collapsible media bag; and (b) a second end in sealed fluid communication with the first end of the delivery tube.

12. A fluid transport system as recited in claim 11, wherein the media bag has a bottom end and the fluid transport system further includes anchoring means for securing the first end of the delivery tube to the bottom end of the media bag to enable fluid to enter the first end of the dip tube thereat.

13. A fluid transport system as recited in claim 12, wherein the anchoring means comprises:

(a) a mounting plate having a top surface and a bottom surface, the bottom surface being secured to the bottom end of the media bag;

(b) a spout projecting from the top surface of the mounting plate to an attachment end, the spout also having an interior surface defining a passageway extending from the attachment end to the mounting plate; and (c) a side port extending through the spout so as to be in fluid communication with the passageway of the spout when the attachment end is fluid coupled to the first end of the dip tube.

14. A fluid transport system as recited in claim 1, wherein the delivery tube is flexible.

15. A fluid transport system as recited in claim 1, further comprising:

(a) a supply tube comprising a first end attached in sealed fluid communication with the closed sterile environment of the containment means, an opposing second end being sealed closed, and an interior surface defining a lumen extending between the first end and the second end; and (b) second sealing means disposed at a point along the supply tube for effecting a pressure tight seal of the inlet opening without breaching the closed sterile environment of the containment means to enable pressurization of the chamber of the pressure vessel when the containment means is positioned within the chamber and the second end of the supply tube is passed from within the chamber though the inlet opening so as to be outside of the pressure vessel.

16. A fluid transport system as recited in claim 12, wherein the second sealing means comprises:

(a) a tubular sleeve having an exterior surface and being fluid coupled in axial alignment with the supply tube at a point between the first end and the second end of the supply tube; and (b) a gasket encircling and radially extending out from the exterior surface of the tubular sleeve, the gasket extending to an outside perimeter that is larger than the inner diameter of the inlet port, the gasket being sufficiently flexible to pass through the inlet opening.

17. A fluid transport system for selectively dispensing a fluid from within a pressure vessel, the pressure vessel comprising a housing having an interior surface defining a chamber, the pressure vessel further comprising an outlet opening having an inner diameter and being formed on the housing and an inlet opening having an inner diameter and being formed on the housing, the inlet opening and the outlet opening each effecting discrete fluid communication between the chamber of the pressure vessel and the exterior of the pressure vessel, the fluid transport system comprising:

(a) a collapsible media bag having an interior surface defining a compartment for containing a fluid;

(b) a delivery tube comprising:

(i) a first end in sealed fluid communication with the compartment of the media bag;

(ii) an opposing free second end being sealed closed; and (iii) an interior surface defining a lumen extending between the first end and the second end, the lumen of the delivery tube and the chamber of the media bag comprising a closed sterile environment; and (c) first sealing means disposed at a point along the delivery tube for effecting a pressure tight seal of the outlet opening without breaching the closed sterile environment to enable pressurization of the chamber of the pressure vessel when the media bag is positioned within the chamber and the second end of the delivery tube is passed from within the chamber though the outlet opening so as to be outside of the pressure vessel.

18. A fluid transport system as recited in claim 17, wherein the first sealing means comprises a gasket encircling and radially extending out from the exterior surface of the delivery tube, the gasket extending to an outside perimeter that is larger than the inner diameter of the outlet opening, the gasket being sufficiently flexible to pass through the outlet opening.

19. A fluid transport system as recited in claim 18, wherein the gasket has a first side with an annular ridge projecting therefrom and encircling the delivery tube.

20. A fluid transport system as recited in claim 17, wherein the first sealing means comprises:

(a) a tubular sleeve having an exterior surface and being fluid coupled in axial alignment with the delivery tube at a point between the first end and the second end of the delivery tube; and (b) a gasket encircling and radially extending out from the exterior surface of the tubular sleeve, the gasket extending to an outside perimeter that is larger than the inner diameter of the outlet opening, the gasket being sufficiently flexible to pass through the outlet opening.

21. A fluid transport system as recited in claim 20, wherein the gasket has a first side with an annular ridge projecting therefrom and encircling the delivery tube.

22. A fluid transport system as recited in claim 17, further comprising:

(a) a supply tube comprising a first end attached in sealed fluid communication with the media bag, an opposing second end being sealed closed, and an interior surface defining a lumen extending between the first end and the second end, the lumen of the delivery tube, the lumen of the supply tube, and the chamber of the media bag comprising the closed sterile environment; and (b) second sealing means disposed at a point along the supply tube for effecting a pressure tight seal of the inlet opening without breaching the closed sterile environment to enable pressurization of the chamber of the pressure vessel when the media bag is positioned within the chamber of the pressure vessel and the second end of the supply tube is passed from within the chamber though the inlet opening so as to be outside of the pressure vessel.

23. A fluid transport system as recited in claim 22, wherein the second sealing means comprises:

(a) a tubular sleeve having an exterior surface and being fluid coupled in axial alignment with the supply tube at a point between the first end and the second end of the supply tube; and (b) a gasket encircling and radially extending out from the exterior surface of the tubular sleeve, the gasket extending to an outside perimeter that is larger than the inner diameter of the inlet port, the gasket being sufficiently flexible to pass through the inlet opening.

24. A fluid transport system for selectively dispensing a fluid from within a pressure vessel, the pressure vessel comprising a housing having an interior surface defining a chamber, a first sealing flange and a second sealing flange are formed on the housing of the pressure vessel, an outlet opening having an inner diameter extends through the first sealing flange so as to be in fluid communication with the chamber of the pressure vessel, likewise, an inlet opening having an inner diameter extends through the second sealing flange so as to be in fluid communication with the chamber of the pressure vessel, the fluid transport system comprising:

(a) a collapsible media bag having an interior surface defining a compartment for containing a fluid;

(b) a delivery tube having a lumen longitudinally extending therethrough, the delivery tube comprising:

(i) a transition tube having a first end in sealed fluid communication with the media bag and an opposing second end; and (ii) a feeding tube having a first end and an opposing second end, the second end being sealed closed;

(c) a first interface adapter comprising:

(i) a tubular sleeve having a first end, an opposing second end, and an exterior surface extending therebetween, the tubular sleeve also having an interior surface defining a passageway extending between the first end and the second end, the first end of the tubular sleeve being fluid coupled with the second end of the transition tube, the second end of the tubular sleeve being fluid coupled with the first end of the feeding tube; and (ii) a gasket encircling and radially extending out from the exterior surface of the tubular sleeve, the gasket extending to an outside perimeter that is larger than the inner diameter of the outlet opening extending through the first sealing flange, the gasket being sufficiently flexible that the interface adapter positioned within the chamber can be constricted to pass through the outlet opening in the first sealing flange and then expanded to enable the gasket to be mounted flush against the first sealing flange on the housing.

25. A fluid transport system as recited in claim 24, wherein the gasket has a first side with an annular ridge projecting therefrom and encircling the delivery tube.

26. A fluid transport system as recited in claim 25, wherein the gasket has a second side with an annular ridge projecting therefrom and encircling the delivery tube.

27. A fluid transport system as recited in claim 24, further comprising a first barbed adapter having a first end, a second end, and an interior surface defining a path extending therebetween, the first end of the first barbed adapter being received within the second end of the transition tube, the second end of the first barbed adapter being received within the first end of the tubular sleeve of the interface adapter.

28. A fluid transport system as recited in claim 27, wherein the first barbed adapter further comprises an exterior surface having an annular barb encircling and radially projecting from the exterior surface of the first end and the second end.

29. A fluid transport system as recited in claim 24, further comprising a second barbed adapter having a first end, a second end, and an interior surface defining a path extending therebetween, the first end of the second barbed adapter being received within the second end of the tubular sleeve of the interface adapter and the second end of the second barbed adapter being received within the first end of the feeding tube.

30. A fluid transport system as recited in claim 29, wherein the second barbed adapter further comprises an exterior surface having an annular barb encircling and radially projecting from the exterior surface of the first end and the second end.

31. A fluid transport system as recited in claim 24, further comprising:

(a) a supply tube having a lumen longitudinally extending therethrough, the supply tube comprising:

(i) a transaction tube having a first end fluid coupled with the compartment of the media bag and an opposing second end positioned outside of the media bag; and (ii) a source tube having a first end and an opposing second end, the second end being sealed closed;

(b) a second interface adapter comprising:

(i) a tubular sleeve having a first end, an opposing second end, and an exterior surface extending therebetween, the tubular sleeve also having an interior surface defining a passageway extending between the first end and the second end, the first end of the tubular sleeve being fluid coupled with the transition tube, the second end of the tubular sleeve being fluid coupled with the first end of the source tube; and (ii) a gasket encircling and radially extending out from the exterior surface of the tubular sleeve, the gasket extending to an outside perimeter that is larger than the inner diameter of the inlet opening extending through the second sealing flange, the gasket being sufficiently flexible that the second interface adapter positioned within the chamber can be constricted to pass through the inlet opening in the sealing flange and then expanded to enable the gasket to be mounted flush against the second sealing flange on the housing.

32. A fluid transport system as recited in claim 24, further comprising a dip tube having:

(a) the first end disposed within a collapsible media bag; and (b) a second end in sealed fluid communication with the first end of the delivery tube.

33. A fluid transport system as recited in claim 32, wherein the media bag has a bottom end and the fluid transport system further includes anchoring means for securing the first end of the dip tube to the bottom end of the media bag to enable fluid to enter the first end of the dip tube thereat.

34. A fluid transport system as recited in claim 33, wherein the anchoring means comprises:

(a) a mounting plate having a top surface and a bottom surface, the bottom surface being secured to the bottom end of the media bag;

(b) a spout projecting from the top surface of the mounting plate to an attachment end, the spout also having an interior surface defining a passageway extending from the attachment end to the mounting plate; and (c) a side port extending through the spout so as to be in fluid communication with the passageway of the spout when the attachment end is fluid coupled to the first end of the dip tube.

35. A fluid dispensing system comprising:

(a) a pressure vessel comprising a housing having an interior surface defining a chamber and an outlet opening formed on the housing to enable fluid communication between the chamber of the pressure vessel and the exterior of the pressure vessel;

(b) a delivery tube comprising a first end, an opposing second end being sealed closed, and an interior surface defining a lumen extending between the first end and the second end;

(c) containment means attached in sealed fluid communication with the first end of the delivery tube for forming a closed sterile environment capable of receiving and containing a fluid and for dispensing the contained fluid into the delivery tube when pressure is applied to the containment means;

(d) first sealing means disposed at a point along the delivery tube for effecting a pressure tight seal of the outlet opening without breaching the closed sterile environment of the containment means to enable pressurization of the chamber when the containment means is positioned within the chamber and the second end of the delivery tube is passed from within the chamber though the outlet opening so as to be outside of the pressure vessel; and (e) first attachment means for removably securing the sealing means to the housing.

36. A fluid dispensing system as recited in claim 35, wherein the containment means comprises a collapsible media bag having an interior surface defining a compartment for containing a fluid.

37. A fluid dispensing system as recited in claim 35, wherein the sealing means comprises a gasket encircling and radially extending out from the exterior surface of the delivery tube, the gasket extending to an outside perimeter that is larger than the inner diameter of the outlet opening, the gasket being sufficiently flexible to pass through the outlet opening.

38. A fluid dispensing system as recited in claim 35, wherein the first sealing means comprises an interface adapter including:

(a) a tubular sleeve having an exterior surface and being fluid coupled in axial alignment with the delivery tube at a point between the first end and the second end of the delivery tube; and (b) a gasket encircling and radially extending out from the exterior surface of the tubular sleeve, the gasket having a first side, a second side, and extending to an outside perimeter that is larger than the inner diameter of the outlet opening, the gasket being sufficiently flexible to pass through the outlet opening.

39. A fluid dispensing system as recited in claim 38, wherein the gasket has a first side with an annular ridge projecting therefrom and encircling the delivery tube.

40. A fluid dispensing system as recited in claim 38, wherein the attachment means comprises:

(a) a sealing flange formed on the exterior of the housing, the sealing flange having an exposed face with the outlet opening extending therethrough, the sealing flange being configured to engage the first side of the gasket when the interface adapter is passed through the outlet opening to the exterior of the housing; and (b) a clamp configured to compress the first side of the gasket against the face of the sealing flange.

41. A fluid dispensing system as recited in claim 40, wherein the first attachment means further comprises a compression plate biased against the second face of the gasket.

42. A fluid dispensing system as recited in claim 41, wherein the compression plate comprises a pair of C-shaped plates biased against the second face of the gasket so as to encircle the delivery tube.

43. A fluid dispensing system as recited in claim 35, further comprising:

(a) an inlet opening formed on the housing of the pressure vessel to enable fluid communication between the chamber of the pressure vessel and the exterior of the pressure vessel;

(b) a supply tube comprising a first end attached in sealed fluid communication with the sterile environment of the containment means, an opposing second end being sealed closed, and an interior surface defining a lumen extending between the first end and the second end;

(c) second sealing means disposed at a point along the supply tube for effecting a pressure tight seal of the inlet opening without breaching the closed sterile environment of the containment means to enable pressurization of the chamber of the pressure vessel when the containment means is positioned within the chamber and the second end of the supply tube is passed from within the chamber though the inlet opening so as to be outside of the pressure vessel; and (d) second attachment means for removably securing the second sealing means to the housing.

44. A fluid dispensing system comprising:

(a) a pressure vessel comprising a housing having an exterior surface, the housing also having an interior surface defining a chamber located within the pressure vessel, the pressure vessel further comprising:

(i) a sealing flange mounted on the exterior surface of the housing and having an exposed face;

(ii) an outlet opening with an inner diameter extending through the face of the sealing flange so as to be in fluid communication with the chamber of the pressure vessel;

(b) a collapsible media bag having an interior surface defining a compartment for containing a fluid, the media bag being configured to be received within the chamber of the pressure vessel;

(c) a flexible delivery tube having a first end in sealed fluid communication with the compartment of the media bag and an opposing second end, the delivery tube also being configured to be received within the chamber of the pressure vessel;

(d) an interface adapter comprising:

(i) a tubular member having a first end, an opposing second end, and an exterior surface extending between, the tubular member also having an interior surface defining a passageway extending between the first end and the second end, the tubular member being fluid coupled in axial alignment with the delivery tube at a point between the first end and the second end of the delivery tube; and (ii) a gasket encircling and radially extending out from the exterior surface of the tubular member, the gasket having a first side, a second side, and extending to an outside perimeter that is larger than the inner diameter of the outlet opening extending through the sealing flange, the gasket being sufficiently flexible that when the second end of the delivery tube is passed from within the chamber through the outlet opening, the interface adapter can be constricted to also pass through the outlet opening in the sealing flange and then expanded to enable the gasket to be mounted flush against the face of the sealing flange; and (e) clamping means for compressing the interface adapter against the face of the sealing flange to produce a pressure tight seal therebetween.

45. A fluid dispensing system as recited in claim 44, wherein the pressure vessel further comprises a selectively sealable entree port formed on the housing of the pressure vessel to communicate with the chamber, the entree port being configured to enable the media bag and delivery tube attached thereto to be received within the chamber of the pressure vessel.

46. A fluid dispensing system as recited in claim 44, wherein the pressure vessel further comprises a pressure supply line extending through the housing and communicating with the chamber for pressurizing the chamber.

47. A fluid dispensing system as recited in claim 44, further comprising:

(a) an annular ridge projecting from the first side of the gasket and encircling the tubular member; and (b) an annular groove formed on the face of the sealing flange so as to encircle the outlet opening, the annular groove being configured to receive the annular ridge on the first side of the gasket.

48. A fluid dispensing system as recited in claim 44, further comprising a compression plate having a first side and a second side, the compression plate being configured to be biased against the second face of the gasket so as to encircle the tubular member.

49. A fluid dispensing system as recited in claim 48, further comprising:

(a) an annular ridge projecting from the second side of the gasket and encircling the tubular member;

(b) an annular groove formed on the first side of the compression plate, the annular groove on the compression plate being configured to receive the annular ridge on the second side of the gasket.

50. A fluid dispensing system as recited in claim 48, wherein the compression plate comprises a pair of C-shaped plates.

51. A fluid dispensing system as recited in claim 44, further comprising:

(a) a second sealing flange mounted on the exterior surface of the housing and having an exposed face;

(b) an inlet opening with an inner diameter extending through the face of the second sealing flange so as to be in fluid communication with the chamber of the pressure vessel;

(c) a flexible supply tube having a first end in sealed fluid communication with the compartment of the media bag, the supply tube also having an opposing second end;

(d) a second interface adapter comprising:

(i) a tubular member having a first end, an opposing second end, and an exterior surface extending between, the tubular member also having an interior surface defining a passageway extending between the first end and the second end, the tubular member being fluid coupled in axial alignment with the supply tube at a point between the first end and the second end of the supply tube; and (ii) a gasket encircling and radially extending out from the exterior surface of the tubular member, the gasket having a first side, a second side, and extending to an outside perimeter that is larger than the inner diameter of the inlet opening extending through the second sealing flange, the gasket being sufficiently flexible that the second interface adapter positioned within the chamber can be constricted to pass through the inlet opening in the second sealing flange and then expanded to enable the gasket to be mounted flush against the face of the second sealing flange; and (e) clamping means for compressing the second interface adapter against the face of the second sealing flange to produce a pressure tight seal therebetween.

52. A fluid dispensing system as recited in claim 44, further comprising a dip tube having a first end disposed within the compartment of the media bag and an opposing second end in fluid communication with the first end of the delivery tube.

53. A fluid dispensing system as recited in claim 52, further comprising an anchor, the anchor including:

(a) a mounting plate having a top surface and a bottom surface, the bottom surface being secured to the bottom end of the media bag;

(b) a spout projecting from the top surface of the mounting plate to an attachment end, the spout also having an interior surface defining a passageway extending from the attachment end to the mounting plate; and (c) a side port extending through the spout so as to be in fluid communication with the passageway of the spout when the attachment end is fluid coupled to the first end of the dip tube.

54. A method for assembling a system for dispensing sterile fluid solutions, the method comprising the steps of:

(a) obtaining a pressure vessel comprising a housing having an exterior surface, the housing also having an interior surface defining a chamber located within the pressure vessel, the pressure vessel further comprising:

(i) an access door removably sealing an entree port, the entree port extending through the housing and communicating with the chamber;

(ii) an inlet opening extending through the housing and communicating with the chamber to selectively pressurize the chamber; and (iii) an sealing flange formed on the exterior surface of the housing of the pressure vessel, the sealing flange having a outlet opening extending therethrough so as to be in fluid communication with the chamber of the pressure vessel;

(b) positioning a fluid transport system within the chamber of the pressure vessel through the entree port, the transport system comprising:

(i) a collapsible media bag having an interior surface defining a closed compartment for containing a fluid;

(ii) a flexible delivery tube having a first end in sealed fluid communication with the compartment of the media bag, the delivery tube also having an opposing second end being sealed closed; and (iii) a flexible interface adapter comprising:

(A) a tubular member having a first end, an opposing second end, and an exterior surface extending between, the tubular member also having an interior surface defining a passageway extending between the first end and the second end, the tubular member being fluid coupled in axial alignment with the delivery tube at a point between the first end and the second end of the delivery tube; and (B) a gasket encircling and radially extending out from the exterior surface of the tubular member, the gasket extending to an outside perimeter that is larger than the inner diameter of the outlet opening extending through the sealing flange, the gasket being sufficiently flexible to pass from within the chamber through the outlet opening in the sealing flange;

(c) passing the second end of the delivery tube including the interface adapter through the outlet opening so that the gasket is positioned flush against the sealing flange outside of the chamber; and (d) sealing the gasket against the surface of the sealing flange so that the outlet opening is sealed closed, thereby enabling pressurization of the chamber having the media bag contained therein.

* * * * *

UNITED STATES PATENT AND TRADEMARK OFFICE

CERTIFICATE OF CORRECTION

PATENT NO. : 5,799,830

DATED : Sep. 1, 1998

INVENTOR(S) : David C. Carroll; Dennis Brown

It is certified that error appears in the above-identified patent and that said Letters Patent is hereby corrected as shown below:

Col. 2, line 53, after "in" change "axially" to --axial--

Col. 3, line 9, after "over" change "convention" to --conventional--

Col. 5, line 45, after "linear" change "rids" to --ribs--

Col. 6, line 34, after "FIG." change "2" to --3--

Col. 6, line 53, after "radially" change "biased" to --bias--

Col. 7, line 57, after "hood" change "were" to --where--

Col. 7, line 59, after "beneficial" delete --to--

Col. 8, line 15, after "to" insert --media--

Col. 9, line 2, after "To" change "farther" to --further--

Col. 9, line 6, after "of" change "barb" to --barbed--

Col. 9, line 6, after "adapter" change "220" to --212--

Col. 9, line 13, after "the" change "structure" to --structural--

Col. 10, line 1, after "have" change "complimentary" to --complimentarily--

Col. 10, line 55, after "the" change "needs" to --need--

UNITED STATES PATENT AND TRADEMARK OFFICE

CERTIFICATE OF CORRECTION

PATENT NO. : 5,799,830

DATED : Sep. 1, 1998

INVENTOR(S) : David C. Carroll; Dennis Brown

It is certified that error appears in the above-identified patent and that said Letters Patent is hereby corrected as shown below:

Col. 11, line 3, after "positioned" change "with" to --within--

Col. 11, line 15, after "end" change "70" to --68--

Col. 11, line 41, after "plate" change "324" to --234--

Col. 13, line 6, after "chamber" change "though" to --through--

Col. 14, line 20, after "chamber" change "though" to --through--

Col. 14, line 61, after "chamber" change "though" to --through--

Col. 15, line 37, after "chamber" change "though" to --through--

Col. 21, line 19, before "sealing" change "an" to --a--

Signed and Sealed this

Twenty-fifth Day of May, 1999

*Attest:*

*Attesting Officer*

Q. TODD DICKINSON

*Acting Commissioner of Patents and Trademarks*